United States Patent [19]

Slautterback et al.

[11] Patent Number: 4,844,003

[45] Date of Patent: Jul. 4, 1989

[54] HOT-MELT APPLICATOR

[75] Inventors: Fred A. Slautterback, Carmel Valley; W. Harrison Faulkner, III, Salinas, both of Calif.

[73] Assignee: Slautterback Corporation, Monterey, Calif.

[21] Appl. No.: 214,296

[22] Filed: Jun. 30, 1988

[51] Int. Cl.[4] ..... B05B 3/00

[52] U.S. Cl. ..... 118/323; 118/313; 118/314; 118/315; 222/566; 222/570; 239/270; 239/294; 239/298; 427/208.2; 427/265; 427/424

[58] Field of Search ..... 222/566, 570; 118/313, 118/314, 315, 323; 427/208.2, 424, 265; 239/270, 294, 298

[56] References Cited

U.S. PATENT DOCUMENTS 3,348,520 10/1967 Lockwood ..... 118/2

4,031,854 6/1977 Sprague, Jr. ..... 118/641

*Primary Examiner*—Bernard Pianalto

*Attorney, Agent, or Firm*—Thomas Schneck

[57] ABSTRACT

A nozzle and a method for applying adhesive to join two surfaces. The nozzle has a body member and a conical tip extending from an outlet face of the body member. A first pair of gas passageways is disposed on a side of the conical tip opposite a second pair of gas passageways. Each of the four gas passageways has a dispensing orifice at the outlet face of the nozzle body. The pairs of passageways are inwardly directed to project streams of gas, preferably air, parallel opposed sides of the conical tip. Thus, the streams of air converge at a distance from the outlet face beyond the apex of the conical tip. These streams of air cradle a stream of material issuing from the apex of the conical tip and cause an oscillatory zig-zag deposition of material. The deposition on a first surface has a resonant frequency and has smooth, controlled radius turns at its edges. A second surface is then brought into contact with the first surface while the adhesive is still in a fluid state.

5 Claims, 4 Drawing Sheets

HOT-MELT APPLICATOR

DESCRIPTION

1. Technical Field

The present invention relates to a method and to apparatus for the dispensing of viscous fluid materials and in particular to apparatus for the low pressure application of hot-melt adhesive material and the like.

2. Background Art

Hot-melt adhesives are used in the automated packaging industry for sealing cases and cartons. Usually, melted adhesive is extruded under high pressure through a number of nozzles, the adhesive being applied to upper and lower major and minor flaps of cartons in long continuous stripes. It has been realized that continuous stripes of hot-melt adhesive represent a cost-inefficient use of material. A cross-sectional view of a continuous stripe illustrates that a considerable amount of material adds nothing to the strength of the bond between the flaps of a carton, since a significant amount of material solidifies between that portion of material which actually makes contact with one of flaps.

One solution to the waste of material is to produce a series of regular short linear dots or dashes instead of a continuous stripe. In U.S. Pat. No. 3,348,520, Lockwood discloses an apparatus which produces linear dots or dashes of hot-melt by opening and closing valves in the nozzles at a high cycling rate. Valves in the dispensing head are responsive to the alternate high pressure stroke and suction stroke of a pump. The valve in each nozzle also insures clean sharp closure of the nozzles, thereby preventing any tendency towards dripping. Typically, cartons in an automated assembly line travel past the hot-melt adhesive dispenser at a rate of about 100–300 feet per minute. The rapid and repeated opening and closing of the valves, which is required to produce short adhesive dots or dashes, is hard on the seats and valves. Moreover, while the short linear dots and dashes result in a greater ratio of material contacting a carton flap to total material, a considerable percentage of hot-melt adhesive is solidified without contact with a surface to be bonded.

Nozzle assemblies which spray melt materials have had limited success. Such units typically need to be about 6 inches from the application surface for proper spray formation, especially when the generally viscous hot-melt adhesives are used. However, at this distance the melt materials may cool and harden in ambient air before reaching the application surface. At low pressures, inadequate flow and improper spray formation, including misting, may occur. Misting, i.e., the production of extremely fine droplets of melt material, is undersirable for some applications, such as the sealing of cartons.

In U.S. Pat. No. 4,031,854, Sprague, Jr. teaches a method in which adhesive is extruded as a band of overlapping loops when a shoe or the like is moved forwardly. A jet providing a gas stream has a rotational component causing swirling of the extruded adhesive filament. The gas stream should be heated to about 100° F., the nozzle should be within 3 inches of the application surface and the supply rate of fluid adhesive should be such that the filaments are at least two mils in diameter. Otherwise, the adhesive may harden, either before it reaches the application surface, causing stringing, or before the surfaces to be adhered are pressed together.

It is an object of the present invention to provide a method of dispensing hot-melt material and to dispensing nozzle for hot-melt material which operates at low pressure and which results in a considerable savings of the amount of hot-melt material used without stringing, misting or premature hardening of the material.

DISCLOSURE OF THE INVENTION

The above object has been met by a nozzle which causes an on-the-fly stream of material to oscillate. The material is deposited on a surface in a zig-zag pattern having smooth radius turns at the edges of the pattern. The nozzle includes a body member and a conical tip extending from a gas outlet face of the body member. A hot-melt material flow path extends from the body member and through an axial bore in the conical tip for extrusion from the conical tip distal the gas outlet face.

The body member includes at least four gas passageways. First and second pairs of gas passageways are disposed on opposite sides of the conical tip. Streams of gas from the gas passageways exit from dispensing orifices at the gas outlet face of the body member. The first pair of passageways is convergently directed relative to the second pair so that the streams of gas converge at a distance beyond the apex of the conical tip. Preferably, the gas streams are directed parallel to the surface of the conical tip. Moreover, the gas passageways of each pair of gas passageways are convergently directed relative to each other. Thus, the four streams of gas converge to cradle the on-the-fly continuous stream of fluid material extruded from the conical tip. The gas outlets are preferably symmetrically distributed about the material outlet.

The nozzle does not break up or atomize the fluid stream, but instead causes formation of a single, fluid filament which moves at high velocity in a controlled state. It is believed that vortices created by the converging gas streams cause the fluid stream to oscillate in the directions associated with the first and second pair of gas passageways. At the edges of the oscillating pattern, the controlled fluid filament makes a smooth radius turn and then returns to overlap the previously deposited material. The oscillation rate is dependent on the air pressure and the fluid velocity, while pattern width is dependent upon the air pressure and the distance between the conical tip and a work surface.

The pattern of deposition is a function of the speed of a work surface relative to a nozzle. Where the pattern is deposited on a moving substrate at speeds approximating 400 feet per minute, the filament is laid down in a sine wave. As the speed of the substrate is decreased, the wave is shortened and the pattern overlaps upon itself, causing a zig-zag pattern. An advantage of the present invention is that this pattern of filamentary material crossing forms wet nodes that concentrate materials, such as adhesive for strong bond points. The thinner, non-overlapping sections are important for quick bond set.

Another advantage of the present invention is that the material flow path through the body member is yieldingly blocked by a stop, thereby preventing material passage in a nonpressurized situation. The yieldingly biased stop eliminates dripping between applications. A further advantage for deposition of adhesives is that because the adhesive is deposited as a highly controlled filament with smooth radius turns in a straight pattern alignment, the amount of adhesive necessary to insure a secure bond is reduced. Typically, a plurality of nozzles are attached to a dispensing member for application to a substrate.

BEST MODE FOR CARRYING OUT THE INVENTION

Figure 1:
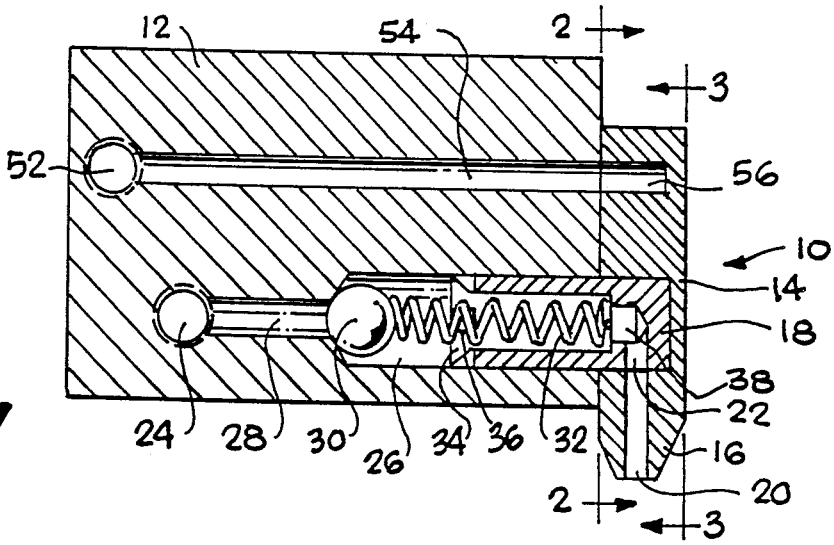
FIG. 1 is side sectional view of a nozzle in accord with the present invention.
Figure 3:
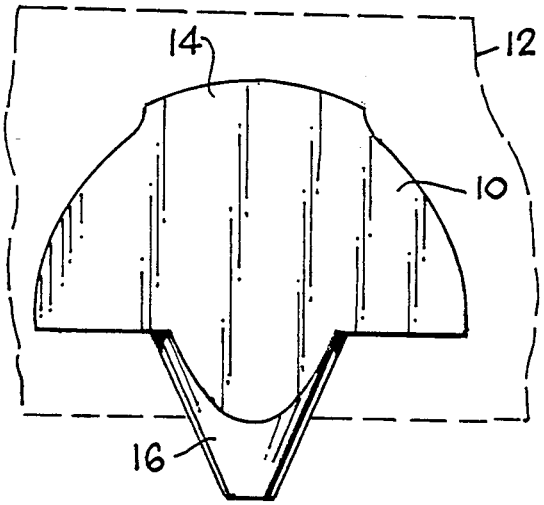
FIG. 3 is a front view of the nozzle of FIG. 1 taken along lines 3—3.
Figure 2:
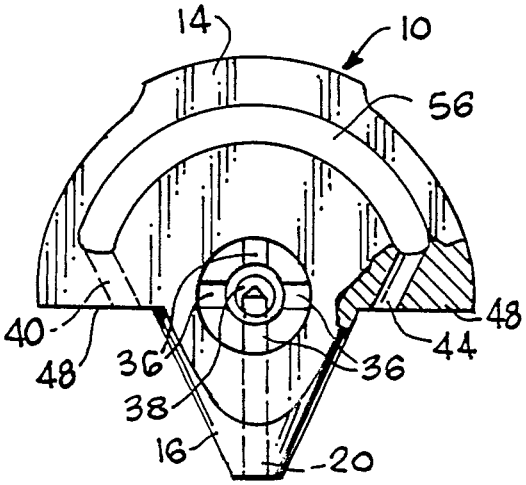
FIG. 2 is a rear, partially sectional view of the nozzle of FIG. 1 taken along lines 2—2.

Referring to FIGS. 1–3, a nozzle 10 is shown fixed to a dispensing member 12. The nozzle 10 includes a body member 14 and an extension segment, or conical tip 16. FIG. 1 shows the nozzle 10 as having an insert 18 which links the nozzle to the dispensing member 12.

An axial bore 20 extends through the conical tip 16 into the nozzle body member 14. The axial bore 20 partially defines a material flow path through the nozzle 10. The axial bore 20 lines up with a secondary orifice 22 in the insert 18. The insert is typically press fit into the body member 14, whereafter the axial bore 20 and secondary orifice 22 are drilled into the nozzle 10. The axial bore 20 and secondary orifice 22 each have a diameter less than the diameter of the passages which supply hot-melt material from the dispensing member 12. Yet, the diameters of the axial bore and the secondary orifice are relatively large. Large diameter orifices are employed to significantly reduce nozzle plugging due to adhesive contamination. Such diameter orifices tend to plug frequently if in-line filters are not employed. Opening up the orifice to at least 0.04 inches significantly reduces, and in many cases totally eliminates, plugging without the use of filters. The reason for this is the cross-sectional area of the opening increases on a squared basis (e.g., a 0.04 inch nozzle area is 16 times larger than a 0.01 inch nozzle).

The material flow path to the axial bore 20 is from a first longitudinal bore 24 in the dispensing member 12 to a chamber 26 via a material passageway 28, and then through the insert 18. Flow from the material passageway 28 into the chamber 26 is yieldingly locked by stop 30 and a helical spring 32. The stop 30 acts as a valve which is biased by helical spring 32 to block flow into the nozzle 10. The helical spring 32, however, yieldingly urges the stop so that the stop is capable of axial movement when a threshold hot-melt material pressure is reached. Nozzle 10 operates at low pressure, with hot-melt being at a pressure at approximately 300 pounds per square inch. In an automated assembly line application of hot-melt material is repeatedly pressurized and then depressurized. When pressurized, the hot-melt material exceeds the threshold pressure which is required to move the stop 30. Hot-melt material may then flow around the stop. Upon depressurization, the stop once again seats against the material passageway 28. Thus, any tendency of a nozzle to drool between applications is overcome.

The portion of the insert 18 fitted within the dispensing member 12 has a slotted head 34. The head 34 of the insert has crossed slots 36, permitting material flow into the insert should the pressure of the material be sufficient to push the stop 30 against the insert 18. In such a case, material flow is around the stop 30 and into the slots 36 for passage to the axial bore 20. Material flow into the insert 18 progresses from a primary orifice 38 into the secondary orifice 22.

Figure 4:
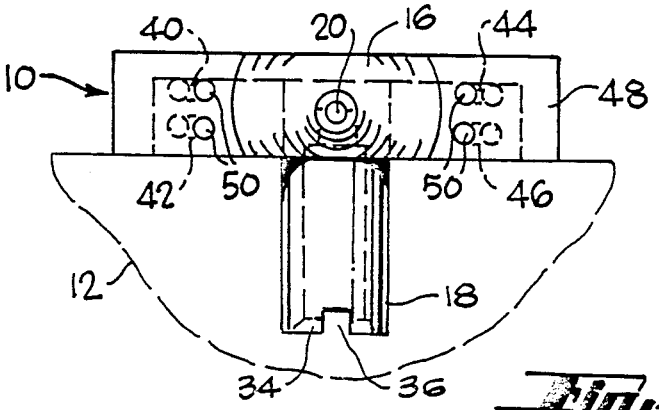
FIG. 4 is a bottom view of the nozzle of FIG. 3.

In addition to the hot-melt material flow path, the nozzle 10 includes a plurality of gas passageways 40, 42, 44 and 46, as shown in FIGS. 2 and 4. The gas passageways 40–46 are angularly directed relative to an outlet face 48 of the body member 14. The angle of the gas passageways is such that jets of gas are projected from dispensing orifices 50 for jet flow parallel to the surface of the conical tip 16. Streams of gas from a first pair of passageways 40 and 42 therefore converge with streams of gas from a second pair of passageways 44 and 46 at a distance beyond the apex of the conical tip 16. Moreover, as shown in FIG. 4, the gas passageways of each pair of passageways are also convergently directed. Thus, the four streams of gas converge to "cradle" an on-the-fly stream of hot-melt material extruded from the axial bore 20.

As will be explained more fully below with reference to FIGS. 7–7C, the cradling of the stream of hot-melt material results in an oscillatory deposition of material. That is, the streams of gas from passageways 40–46 provide a high degree of control by causing material deposition to reach a resonant frequency, as the direction of material alternates between the sides of the nozzle associated with the pairs of passageways. In reaching a resonant frequency the edges of a pattern are directional changes of smooth radius turns. Consequently, there is no overspray or splatter of adhesive beyond the pattern edge.

Referring now to FIGS. 1 and 2, fluid flow to the gas passageways 40 and 44 originates from a second longitudinal bore 52 in the dispensing member 12. The second longitudinal bore is in the fluid communication with a supply of gas, preferably air. Gas flow progresses through a transverse bore 54 and into the nozzle 10. The nozzle includes an arcuate channel 56 which is in the fluid communication with each of the gas passageways.

Figure 5:
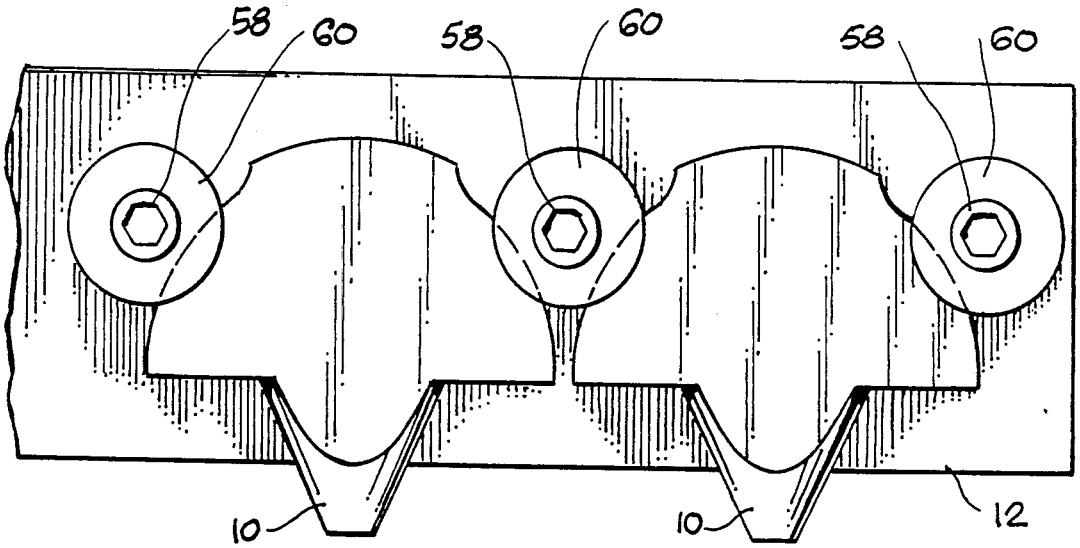
FIG. 5 is a front view of a pair of nozzles on a dispensing member.

As shown in FIG. 5, nozzles 10 are secured to a dispensing member 12 by hex head screws 58 and washers 60. The nozzles 10 may be rotated in place by release of the force exerted by washers 60, thereby providing an aimable nozzle.

Figure 6:
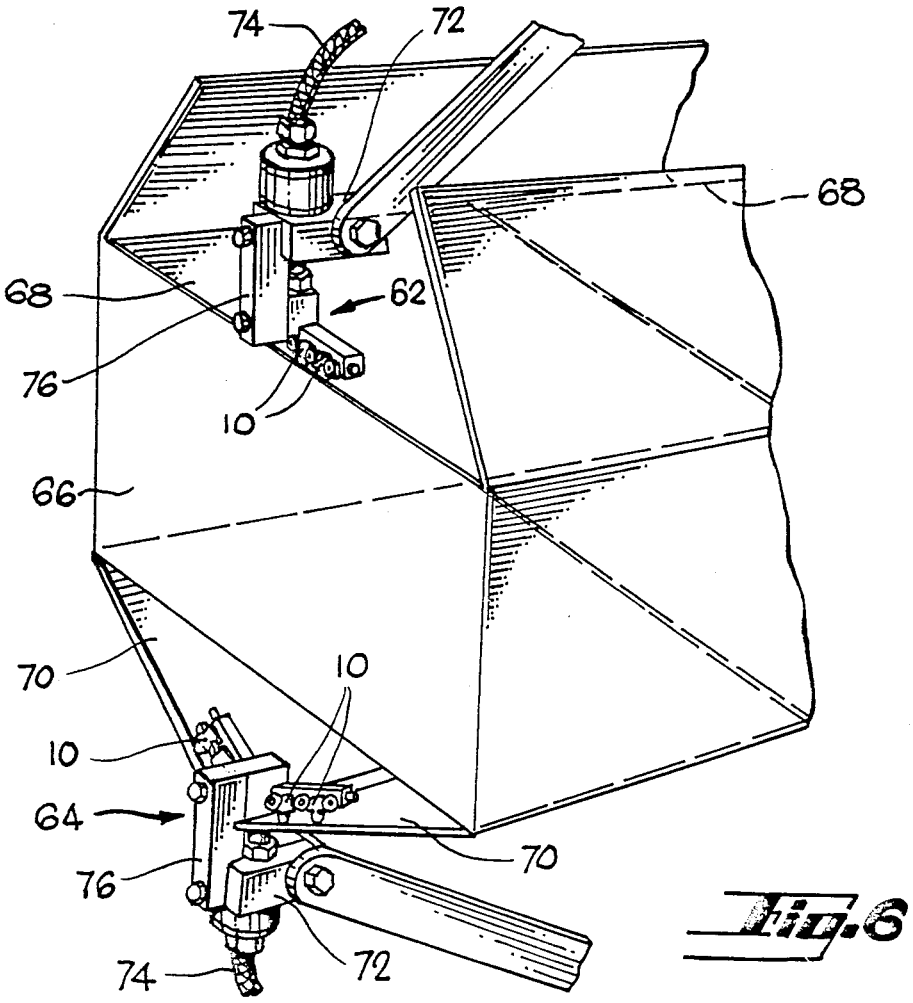
FIG. 6 is a perspective view showing the nozzles of FIG. 5 in a carton sealing configuration for the application of hot-melt adhesive to carton flaps.

Two embodiments of a nozzle manifold assembly 62 and 64 are shown in use in an automatic box sealing assembly line in FIG. 6. As a carton 66 moves along rollers, not shown, hot-melt adhesive is sprayed from nozzles 10 onto the outside surface of the top minor flaps 68 and onto the inside surfaces of the bottom major flaps 70. The nozzle manifold assemblies 62 and 64 are attached to fixed position heated hot-melt dispenser heads 72 through which hot-melt adhesive passes by means of solenoid valves from hoses 74 connected to melting tanks, not shown.

Heat transfer blocks 76 conduct heat from the heated dispenser heads 72 to the nozzle manifolds. These blocks should be sufficiently massive and thermally conductive to be a heat reservoir which will maintain the temperature at the nozzles 10 with a temperature drop relative to the head of 40°-50° F., without a separate heat source for the blocks. The hoses 74 are also connected to a supply of gas, preferably air.

The top-apply manifold assembly 62 is shown to be an inverted T-shaped configuration with nozzles 10 placed on the front side of the dispensing head. The bottom-apply manifold assembly 64 is a Y-shaped configuration with the nozzles 10 facing toward the dispenser head 72, thus facilitating contact with the inner surface of the bottom major flaps 70 of the carton. Each nozzle manifold assembly 62 and 64 administers a plurality of adhesive patterns at a resonant frequency. Where the carton 66 is moved at a speed approximating 400 feet per minute, the pattern is sinusoidal. As the speed of the carton is decreased, the waves are shortened and the pattern overlaps at width edges. This overlapping forms wet nodes which concentrate the adhesive for strong bond points. The non-overlapping portions of the pattern are important for quick bond set. Whether the pattern is sinusoidal or an overlapping "zipper" pattern, the edges of the pattern are characterized by smooth radius turns in straight longitudinal alignment.

Figure 7:
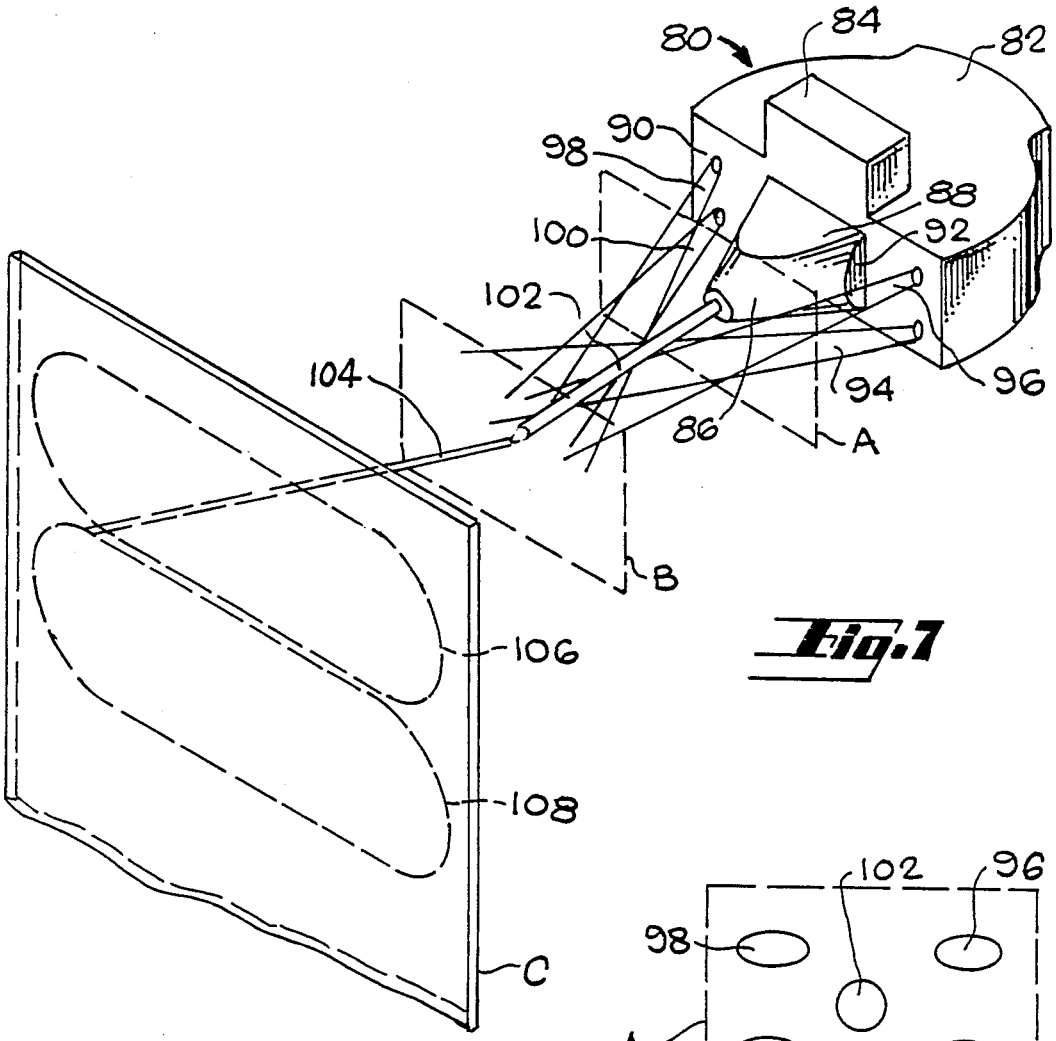
FIG. 7 is an operational view of a second embodiment of a nozzle.

FIG. 7 illustrates a second embodiment of a nozzle 80. The nozzle includes a body member 82 substantially identical to the body member of the nozzle of FIG. 1, with the exception that the body member 82 includes a projecting segment 84 to facilitate insertion and removal of the nozzle from a dispensing member. A conical tip 86 includes forward and rearward planar portions 88. By "conical tip" what is meant is an extension segment from the body member 82 having tapering surfaces at least at the opposed sides associated with projection of streams of gas. The angle of the tapering sides should be substantially identical to the angle of gas projection relative to the outlet face 90 of the body member 82. As shown in FIG. 7, the opposed tapering sides of the conical tip 86 originate in a planar surface 92 which is perpendicular to the outlet face 90. It has been discovered that the planar surface 92 aids in the formation of the desired pattern of adhesive deposition.

In operation, four jets 94, 96, 98 and 100 of gas are projected from the outlet face 90 of the nozzle and a stream of hot-melt material 102 is extruded from the conical tip 86 distal the outlet face 90. Depending upon the desired application, the initiation of the jets of gas may precede, coincide with, or follow the start of material flow through the conical tip. Preferably, the passage of the streams of gas continues after the flow of material has been discontinued, since the velocity of the stream of material relative to the jets of gas will otherwise result in a material deposition which is not uniform. The jets of gas through the apparatus however, should be discontinued between applications in order to minimize a "refrigerator effect" which cools the apparatus.

Figure 7A:
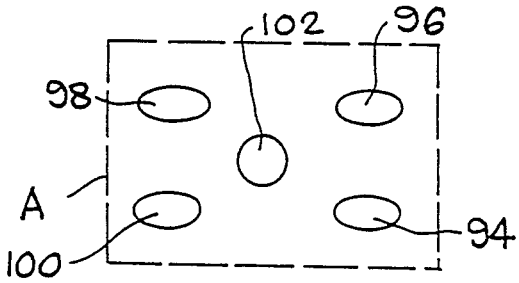
FIGS. 7A–7C illustrate the patterns of streams of gas and material at plains of various distances from the nozzle of FIG. 7.

FIG. 7A illustrates the configuration of jets of gas 94–100 and the stream of material 102 at the apex of the conical tip 86. The jets and the stream of material are spaced apart, but each of the four jets is converging toward the center represented by the stream of material 102. The configuration of the jets of air 94–100 and the stream of material 102 at plane B of FIG. 7 is shown in FIG. 7B. The jets of air contact the stream of material to exert a force upon the material. The velocity of air is greater than the velocity of the material. Consequently, the exit velocity of the material from plane B is substantially higher than the entrance velocity. The jets of air therefore neck down the stream of material to a diameter substantially less than the diameter of the stream extruded from the conical tip 86.

Figure 7C:
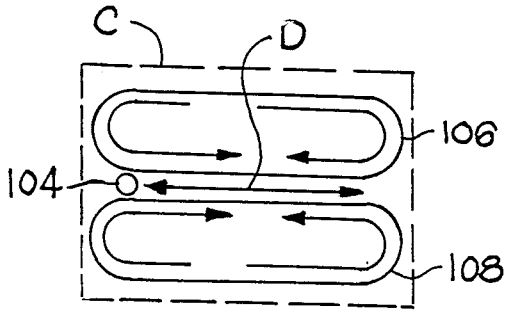
Figure 7B:
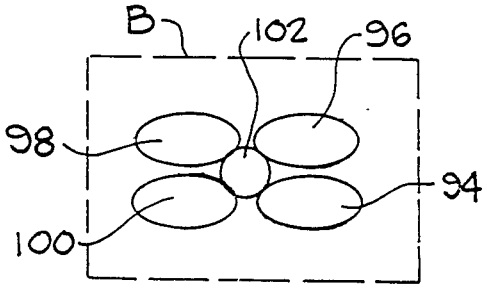

Referring now to FIGS. 7 and 7C, it is believed that the four jets of air 84–100 collide and then exit to form rotating vortices. The rotating directions of the vortices change at a high rate and cause the narrowed stream of material 104 to oscillate. The narrowed stream is trapped between the rotating vortices, indicated by ovals 106 and 108, so that no extraneous adhesive cobwebs or fine particles are created.

The narrowed stream of material 104 strikes a substrate C in an oscillatory manner, as indicated by Arrow D. Preferably, deposition is at a resonant frequency of approximately 300 cycles per second, but the cycle rate is dependent on the air pressure and the adhesive velocity. Displacement, on the other hand, is dependent upon the air pressure and the distance of a nozzle 80 from a substrate C. Typically, the pattern width is adjustable from between 0.25 inch and 1.5 inches.

Figure 8:
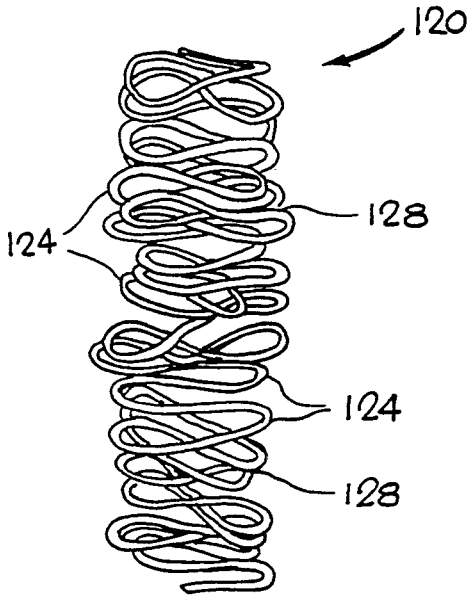
FIGS. 8 and 9 illustrate material patterns obtained by use of the nozzle of FIG. 1.
Figure 9:
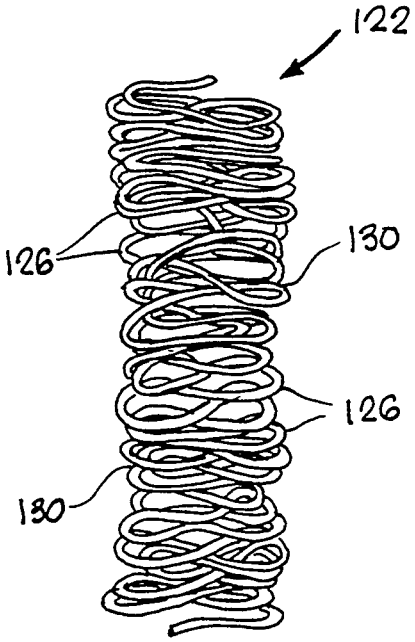

FIGS. 8 and 9 show two actual patterns 120 and 122 obtained by use of the present invention. The patterns are those which are deposited upon a substrate, but are created by oscillating an on-the-fly stream of hot-melt material. Such patterns are formed since the gas streams' aggregate impinging force against the stream of material has a component of force in the direction perpendicular to motion of the substrate that exceeds by orders of magnitude the component of force parallel to the motion of the substrate. Each pattern is a figure eight or zig-zag pattern having smooth radius turns 124 and 126 at the edges of the patterns. The tighter pattern of FIG. 9 can be brought about by either increasing the resonant frequency or by slowing the relative motion between the nozzle and the substrate. The nozzle does not break up or atomize the fluid stream, but instead causes formation of a single, fluid filament which moves at high frequency in a controlled state. As the on-the-fly stream of material is oscillated, the controlled fluid filament makes a smooth radius turn 124 and 126 and then returns to overlap the previously deposited material. The crossings 128 and 130 of material form wet nodes that concentrate the material for strong bond points. The thinner non-overlapping sections, on the other hand, are important for quick bond set.

The patterns 120 and 122 have an appearance resembling a series of interconnecting figure eights. However, the patterns have a degree of randomness or asymmetry which aids in bonding substrates to one another. The degree of randomness insures that the crossings 128 and 130 of material are distributed throughout the width of the pattern as the pattern is deposited in a lengthwise stripe as the nozzle is moved relative to a deposition surface. That is in contrast to a pattern in which all crossings occur equidistantly from the edges of the pattern. The present pattern provides a bond that is more uniform across the width of the deposited material.

As noted above, the non-overlapping sections of deposited filamentary material are important for quick bond set. The non-overlapping sections, like the crossings 128 and 130 of material, are not restricted to particular areas along the width of a pattern 120 and 122, but instead are deposited with a degree of irregularity. The present invention permits deposition of a pattern wherein the ratio of the width of the oscillating filament to the width of the resulting pattern is at least 1:35.

While the nozzle has been described with reference to an applicator which provides vertical application onto a substrate, it is to be understood that the valve nozzle 10 of FIG. 1 may be employed for application onto a vertical substrate. Additionally, the nozzle may be employed for applications other than the sealing of cartons or used with materials other than hot-melt adhesive.

We claim:

1. A nozzle assembly for projecting a stream of fluid onto a substrate, comprising, a nozzle body having interior walls defining first and second sets of passageways therein and having a gas outlet face, each set of passageways convergently directed relative to the other and having at least two gas passageways, each gas passageway having a dispensing orifice at said outlet face, and an extension segment projecting from said outlet face of the nozzle body between said dispersing orifices of said first and second sets of passageways, said nozzle extension segment having at least one interior wall therethrough to define a fluid material flow path, said material flow path of the extension segment having a material flow release orifice distal said outlet face of the nozzle body, thereby precluding mixture of gas and viscous fluid material within a nozzle, and means for moving the nozzle relative to a deposition surface in a line of motion, said sets of passageways directed to issue streams of gas impinging upon a stream of fluid released from said fluid material flow path such that a component of impinging force which is perpendicular to said line of motion exceeds by order of magnitude the component of impinging force parallel to said line of motion.

2. The nozzle assembly of claim 1 wherein said material flow path of said extension segment defines a nozzle axis, said extension segment having an axially tapering configuration, decreasing in cross section from said outlet face of the nozzle body.

3. The nozzle assembly of claim 2 wherein said axially tapering configuration is formed by first and second inclined surfaces, said first set of gas passageways directed to project a plurality of streams of gas parallel said first inclined surface, said second set of gas passageways directed to project streams of gas parallel said second inclined surface.

4. The nozzle assembly of claim 1 wherein said first and second sets of passageway each have a first and second gas passageway, the distance between said first and second gas passageway of each set of passageways decreasing with the distance from said outlet face of the nozzle body.

5. The nozzle assembly of claim 4 wherein said extension segment has a conical configuration and said gas passageways are directed to project streams of gas for convergence at a distance beyond the apex of said extension segment.

* * * * *